United States Patent [19]

Lam et al.

[11] Patent Number: 5,016,024

[45] Date of Patent: May 14, 1991

[54] INTEGRAL INK JET PRINT HEAD

[75] Inventors: Si-Ty Lam, San Jose; William J. Lloyd, Belmont, both of Calif.

[73] Assignee: Hewlett-Packard Company, Palo Alto, Calif.

[21] Appl. No.: 462,670

[22] Filed: Jan. 9, 1990

[51] Int. Cl.[5] ..... B41J 2/05; B41J 2/16

[52] U.S. Cl. ..... 346/1.1; 29/890.1; 346/140 R

[58] Field of Search ..... 346/1.1, 140; 29/890.1

[56] References Cited

U.S. PATENT DOCUMENTS

| | | | |
|---|---|---|---|
| 4,438,191 | 3/1984 | Cloutier et al. | 430/324 |
| 4,490,728 | 12/1984 | Vaught et al. | 346/1.1 |
| 4,580,149 | 4/1986 | Domoto | 346/140 |
| 4,660,058 | 4/1987 | Cordery | 346/140 |
| 4,847,630 | 7/1989 | Bhaskar | 346/140 X |

*Primary Examiner*—Joseph W. Hartary

[57] ABSTRACT

Disclosed is an integral ink jet print head having an improved design. An ink reservoir wall at the base of print head guides a flow of ink from a remote reservoir. Ink is drawn by capillary action past flow restrictors and an ink channel into an ink heating zone. The ink heating zone is a chamber residing below an integrated ink heating structure which has been fabricated, using processes including photolithography, directly on the underside of an orifice plate. An orifice is located to one side of the ink heating zone. The ink heating structure housing the ink heating zone is a combination of thin layers deposited directly on the orifice plate. The multi-layered structure includes an insulating layer of silicon dioxide, a resistive layer of tantalum aluminum alloy, and a top conductive layer formed of gold. The invention provides a single integrated print head that combines the separate elements of the previous designs into one unit having many ink jets on one ink jet print head.

37 Claims, 6 Drawing Sheets

INTEGRAL INK JET PRINT HEAD

BACKGROUND TECHNOLOGY

1. Technical Field

The present invention generally relates to method and apparatus providing a novel manufacturing process and structure for use with thermal ink jet (TIJ) print heads. More specifically, this invention provides an improved integral print head using an ink heating mechanism comprising a series of resistive, conductive, insulative and ink channel layers defined and deposited on an external orifice plate of a print head.

2. Existing Technology: State of the Art

Methods of fabricating conventional ink jet print heads are known to people skilled in the art of electronic printing. A mechanical printer, like a typewriter, uses moving structures that physically apply ink to paper by striking the paper.

In contrast, an electronic print head converts electrical signals received from a data processing device (such as a computer or calculator) to an output that consists of a readable hard copy such as a sheet of paper or a transparency. Some electronic printers rely upon special treated paper which can be altered by the focused application of heat to form contrasting printed characters. This type of thermal printer is inexpensive, compact, and does not require complex mechanisms that are capable of carefully directing ink to a sheet of paper to form patterns that are read as letters and numerals. Thermal printers that heat portions of the paper to "burn in" readable characters are generally quite limited in their capacity to produce clear, sharp, or finely detailed images.

Another type of thermal printer, called a thermal ink jet (TIJ) printer, uses a supply of liquid ink that is guided to a small constricted region below an orifice and then is rapidly heated to form a bubble which ejects ink through the orifice and which impacts on a piece of paper. Each jet is essentially an orifice aligned with an ink heating apparatus. By carefully selecting and energizing an appropriate combination of jets that are arranged on the face of a print head, letters, numbers, and images can be formed directly on to the paper with great accuracy and precision.

FIG. 1(*a*) and FIG. 1(*b*) show schematic views of a state of the art print head.

Print head 10 is shown in cross-section in FIG. 1(*a*) and in a top view in FIG. 1(*b*). A conventional ink heating structure 11 includes a substrate 12, an insulative or insulator layer 13, a resistive layer 14 deposited over substrate 12, and two separated sections (of a conductive material layer 16 placed on top of the resistive layer 14. An ink heating zone 18 is located within a gap between portions of the conductive layer 16.

Ink is drawn to heating zone 18 by capillary action and is guided from a remote reservoir 32 by barriers 20. A metal plate 22, formed with a pattern of holes 24, is suspended over heating zone 18. Plate 22 has an outer face 23 which is facing to deliver ink to a face 29 of a printed media such as a sheet of paper 27. When an electrical voltage from an electricity source (not shown) is applied across the gap between the two separated sections 16*a* and 16*b* of conductive layer 16, a current flows through resistive layer 14 bridging this gap which defines heating zone 18.

The current quickly heats resistive layer 14, which in turn rapidly raises the temperature of the ink overlying resistor 14. The intense heat creates reproducible vapor bubbles from the superheated ink; the bubbles propel ink through orifices 24 in plate 22. Each orifice 24 in the plate 22 must be carefully aligned with its corresponding heating zone 18.

A typical ink jet print head may include approximately one to fifty holes 24 in orifice plate 22 through which ink droplets are expelled toward a sheet of paper (not shown) that is held directly in front of the print head 10. By simultaneously stimulating many sections of resistive layer 14 across the print head 10, ink is expelled in groups of droplets that form letters, characters, and images once they impact the sheet of paper held in the printer.

Existing Technology: Problems

These conventional configurations have problems that limit printer performance, degrade printing capacity, and shorten printhead lifetime.

Expensive and Complex to Make. Existing print heads are expensive to make and difficult to align and assemble. Each orifice plate 22 must be precisely assembled so that the orifices 24 register perfectly with an associated heating zone 18. Since the fabrication of this type of print head is so complex and difficult, the number of jets that are usually available to provide high resolution printing is greatly constricted by the prohibitive costs of manufacture. Even if the manufacturing process is sufficiently accurate to ensure the proper alignment, the high operating temperatures of the print head can distort the original precision assembly and greatly impair the overall quality of the printer. A larger number of orifices can be increased by carefully aligning multiple small printheads on one carrier, but this is costly.

Degraded Reliability and Quality. The problem of providing a highly reliable thermal ink jet print head has presented a major challenge to designers in the electronic printing business. The development of an improved ink jet print head which could overcome this impediment would represent a major technological advance in the field of computer peripheral devices. The enhanced levels of print quality and extended lifetime that could be achieved using such an innovative device would satisfy need within the industry and would enable printer manufacturers and computer users to save time and money.

SUMMARY OF THE INVENTION

The print head of this invention offers a unitary structure that is simple and inexpensive to fabricate, has no moving parts, and provides the capability to produce a printhead with a large array of orifices to thereby produce high resolution printed characters and images.

Broadly stated, the method and apparatus of this invention provides an integral ink jet print head. The print head is formed for transferring an ink from an ink reservoir to a print medium such as paper. The print head heats the ink with a resistor through which is pulsed an electric current from a source of electric current.

The print head comprises:

(a) an orifice plate, defining through itself at least one orifice;

(b) an insulative layer, formed over at least a portion of the orifice plate;

(c) a resistive layer, formed over at least a portion of the insulative layer; and (d) an electric current conductive layer, formed over the resistive layer, in such a manner as to produce at least one resistor capable when carrying an electric current of generating heat, thereby establishing at least one resistive heating region adjacent at least one orifice.

The intense heat generated by the resistor vaporizes some of the ink adjacent the resistor to form an expanding vapor bubble. This bubble displaces and ejects some of the ink through an orifice toward the print media.

This print head that is reliable, easily manufactured, and accurate. Additional features the invention, and a more complete understanding of it, will become apparent by reading as a single unit the examples discussed in the following Detailed Description and Drawings.

DETAILED DESCRIPTION OF THE BEST MODE FOR PRACTICING THE INVENTION DEFINED BY THE CLAIMS

The claims define the invention. The invention claimed has a broad scope which includes many narrow specific example methods and apparatus for practicing it.

In contrast to the claims, the Detailed Description and Drawings present a few particular examples to illustrate the claims. The broadly claimed invention is narrowly illustrated below using specific example systems having narrow scopes.

The inventors, in recognition of their legal obligation to do so, present the particular examples they consider to be the best mode(s) of practicing the invention defined by the claims. This best mode disclosure will enable one skilled in the invention's technical art to practice the invention without undue experimentation upon expiration of the patent issued from this application.

Thus, the invention definition and broad scope can only be determined by careful analysis of the appended claims.

System Overview

Figure 2B:
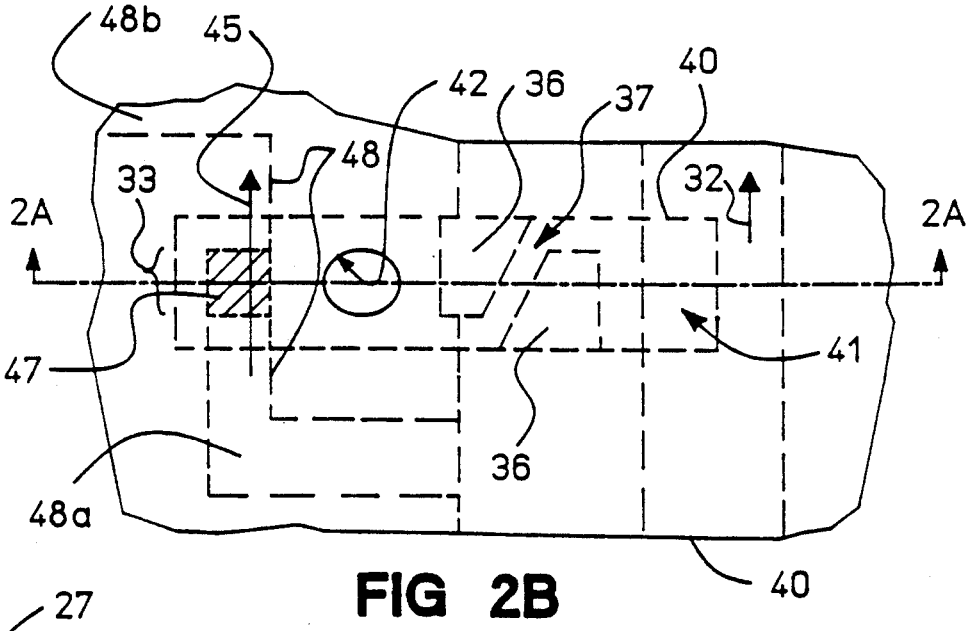
FIGS. 2(*a*) and 2(*b*) show a schematic top and side view of an example construction according to the present invention.
Figure 2A:
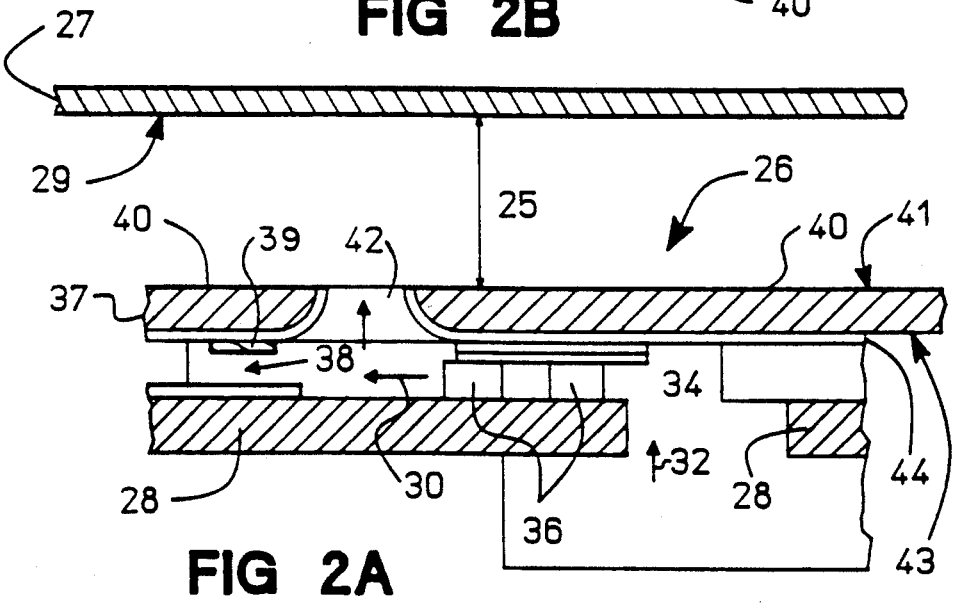
Figure 3A:
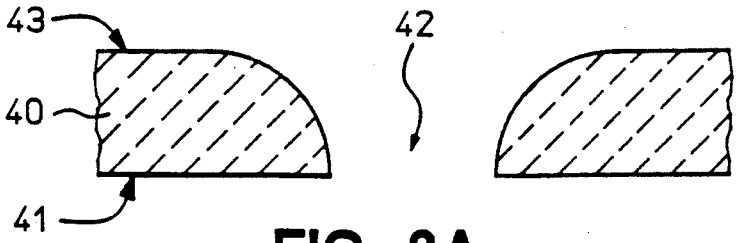
FIGS. 3(*a*)–3(*g*), which to show a different view are inverted views with respect to FIGS. 1 and 2, show a series of successive views illustrating a possible set of fabrication steps which can be used for manufacturing an integral print head according to the claimed invention.
Figure 3B:
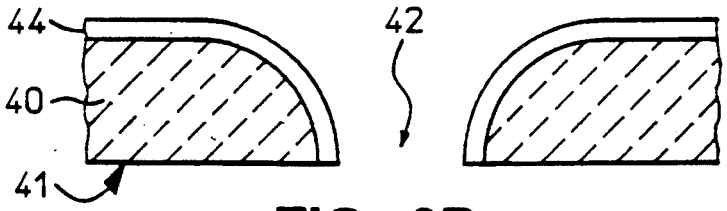
Figure 3C:
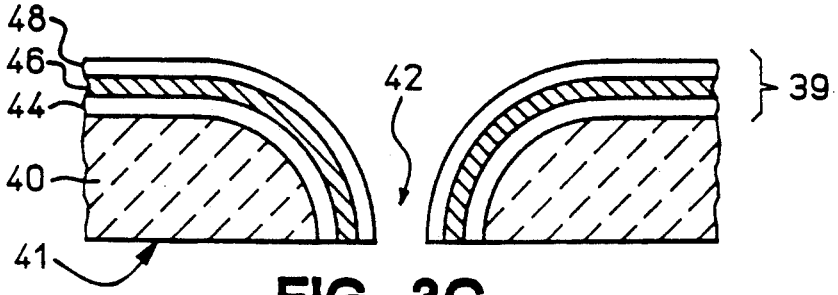
Figure 3D:
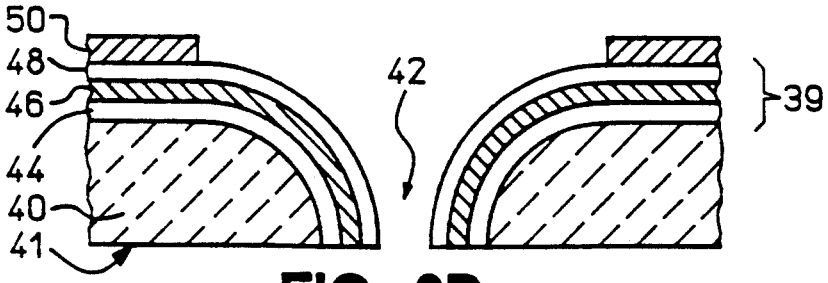
Figure 3E:
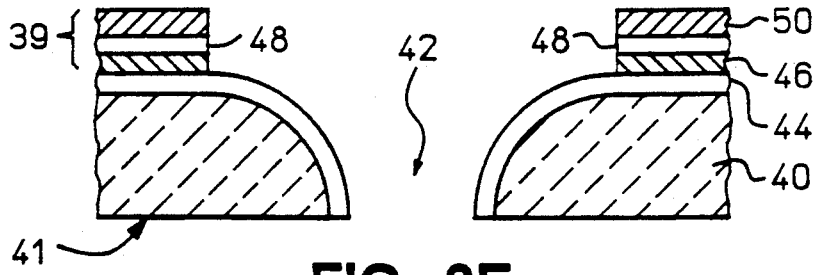
Figure 3F:
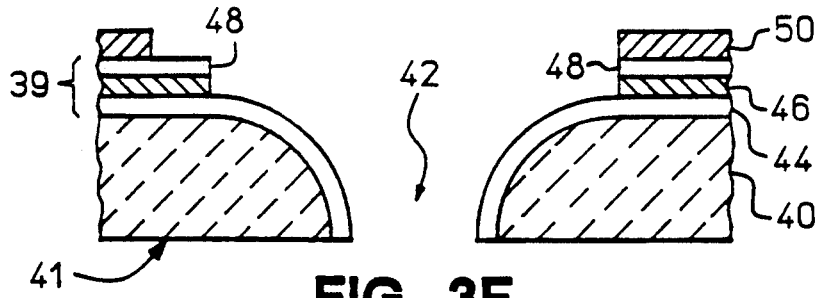
Figure 3G:
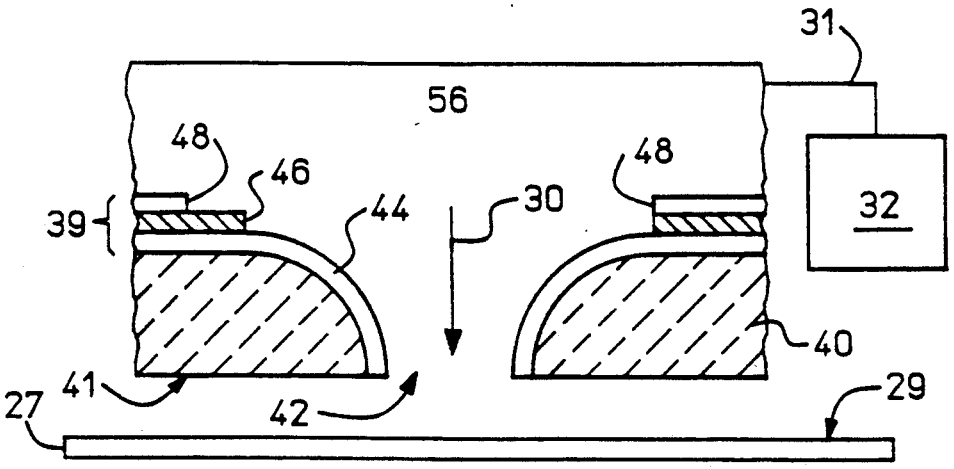
Figure 4A:
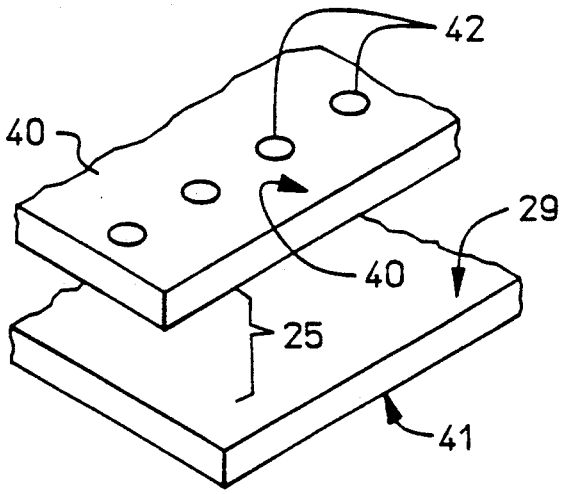
FIGS. 4(*a*)–4(*e*), which to show a different view are inverted views with respect to FIGS. 1 and 2, show an example series of fabrication steps possible according to the claimed invention in a sequence of isometric views that reveal partial cross-sections.
Figure 4B:
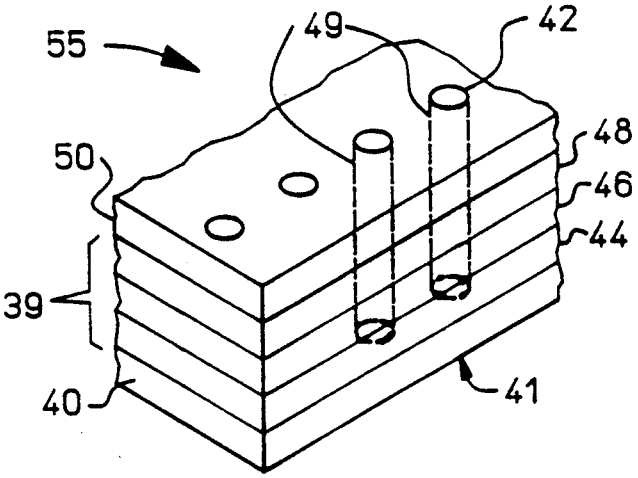
Figure 4C:
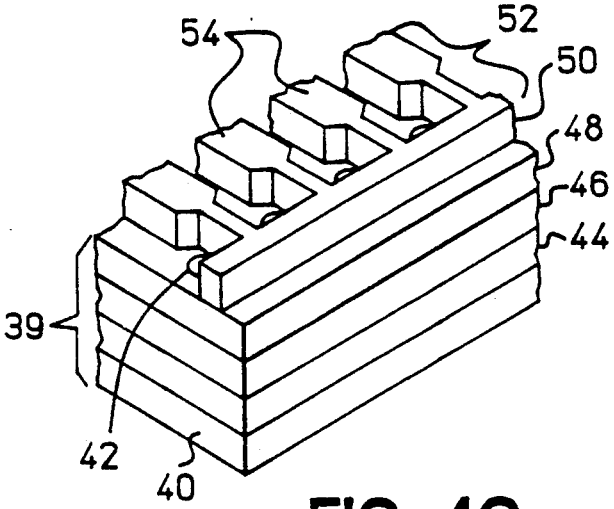
Figure 4D:
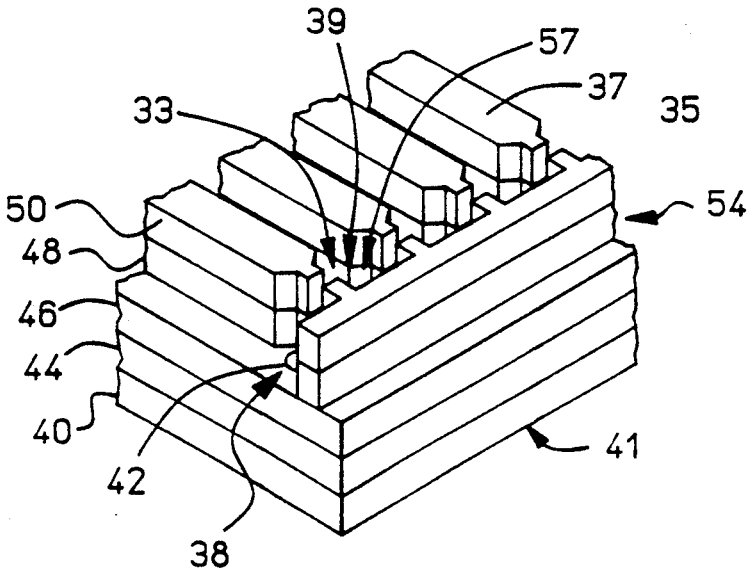
Figure 4E:
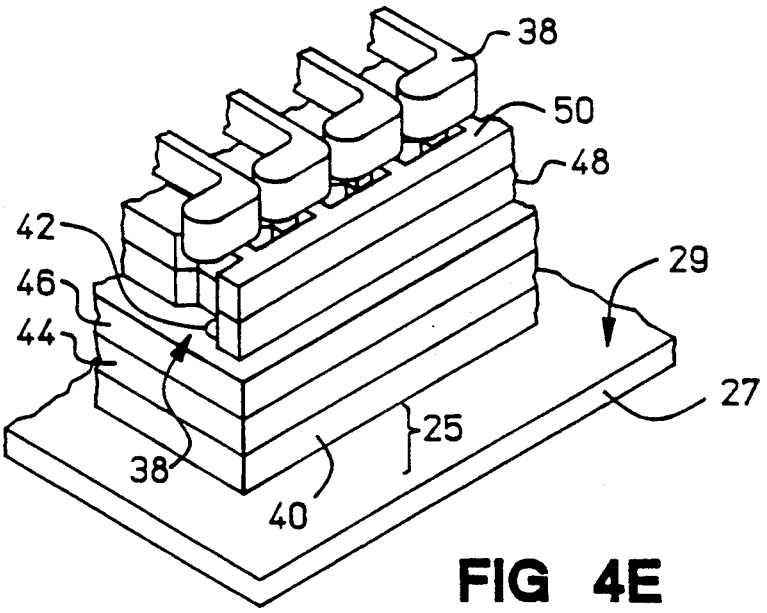

FIGS. 2 and 4 broadly illustrate an example apparatus and method for forming integral ink jet print head 26.

Referring to the reference numbers of the example construction shown in FIGS. 2 and 4, a first embodiment of the method of forming print head 26 comprises the steps of:

(a) forming an orifice plate 40 defining through itself at least one orifice 42;

(b) forming an insulative layer 44 over at least a portion of plate 40;

(c) forming a resistive layer 46 over at least a portion of orifice plate 40;

(d) forming an electric current conductive layer 48 over at least a portion of resistive layer 46;

(e) forming at least one electric current resistive pattern 45 (also known as a resistor 45) coupled to the resistive layer and at least one electric current conductive pattern (branches 48*a* and 48*b* of conductor 48) coupled to conductive layer 48; and (f) forming at least one ink distribution channel 37 adjacent electric current resistive region 45;

whereby ink (not shown) flows to adjacent resistive pattern 45 and then pulsing an electric current through conductive patterns 48*a* and 48*b* and resistive pattern 45 quickly heats the ink causes the ink to be ejected through at least one orifice 42.

A second embodiment presents the case of an orifice plate 40 fabricated from an electrically insulative material such as a polymer, a plastic, a glass, a silicon and other dielectric materials. In this construction, insulative layer 44 is not required.

System Details: Structure—FIGS. 2(*a*) and 2(*b*)

FIGS. 2(*a*) and 2(*b*) show an ink jet print head 26 in two corresponding views that illustrate the invention in partial cross-section.

FIG. 2(*a*) shows a side view of head 26. Included is an ink reservoir wall 28 which guides a flow of ink 30 from an ink reservoir 32. Ink conduits 34 draw the ink by capillary action past flow restrictors 36 and ink channel material 37 into an ink heating zone 38. Flow restrictors 36 enable the ink to flow smoothly in one direction from the reservoir 32 to the resistive layer 46.

Heating zone 38 is a chamber that resides directly below an integral ink heating structure 39 which has been grown directly on the underside or inner face 43 of an orifice plate 40. Plate 40 also has an outer face 41 formed to face a print surface 29 of a print media such as a sheet of paper 27 onto which print characters are to be formed by print head 26. Paper 27 and print head 26 are separated from each other across a variable space 25. As best seen in FIG. 2(*b*), an orifice 42 is defined by two adjacent portions of orifice plate 40 and is located adjacent to the ink heating zone 38.

Heat structure 39 is an important part of print head 26. Heat structure 39 comprises a sandwich-like combination of thin layers (i.e., multi-tiered) that can be formed on orifice plate 40 beside heating chamber 38. Heat structure 39 in this example includes (a) an insulative or insulating layer 44 made for example of silicon dioxide 44, (b) a resistive layer 46 made for example of tantalum aluminum alloy 46, and (c) a top conductive layer or conductor 48 formed for example of gold. Conductor 48 is locally divided and separated into two strips 48*a* and 48*b* by formation of a gap 33 in conductor 48.

Conductive strips 48*a* and 48*b* are attached to resistive layer 46 across gap 33; this construction has the effect of creating a resistor 45 at that region of resistive layer 46 spanning gap 33 between conductors 48*a* and 48*b*. With this arrangement, an electric current delivered from an electric power source (not shown) flows for example into conductor 48*a*, through resistor 45 (because conductor 48 is split in this region across gap 33), and out of conductor 48*b*. Using the well-known Ohm's Law of ohmic heating, resistor 45 generates a quick burst of intense heat. Some of this ink adjacent resistor 45 vaporizes to form a vapor bubble as a result of this intense heat. This expanding vapor bubble displaces some of the ink in the chamber causing it to be ejected through orifice 42 toward face 29 of paper 27.

System Details: Fabrication—FIGS. 3 and 4

FIGS. 3(*a*)–3(*g*) show an example manufacturing process for making integral heating structure or element 39. FIG. 3 is inverted with respect to FIGS. 1 and 2, but aligned in the same orientation as FIG. 4.

FIG. 3(*a*) begins with an orifice plate 40 which can be fabricated for example by electroforming (a) nickel, or (b) nickel alloys such as nickel phosphorous, nickel cobalt, or nickel chrome, or (c) copper. Orifice plate 40 can also be manufactured by etching of such materials as a metal, a non-metal, a glass, a plastic or a silicon wafer.

Figure 1B:
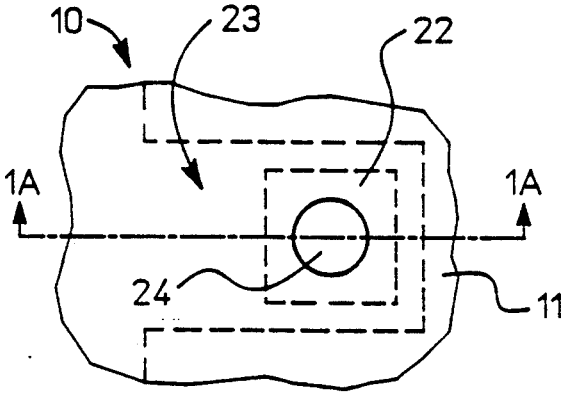
FIG 1B (PRIOR ART)
FIGS. 1(*a*) and 1(*b*) show a state of the art ink jet print head.
Figure 1A:
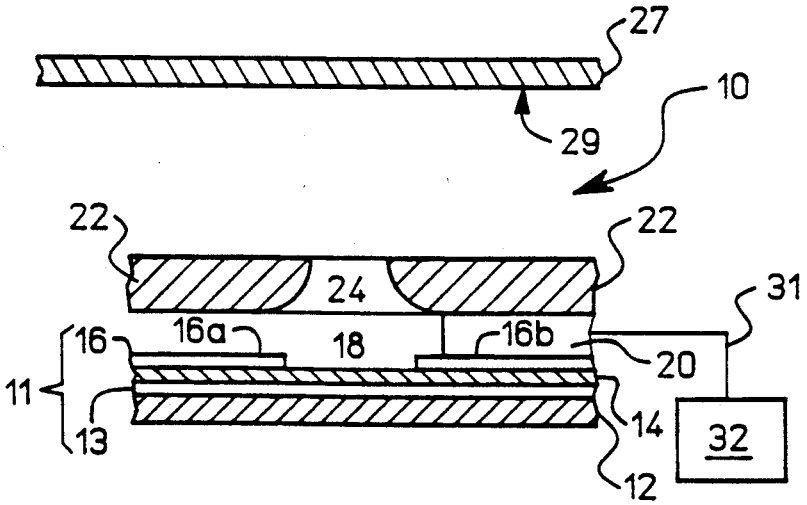
FIG 1A (PRIOR ART)

FIGS. 3(*b*) and 3(*c*), which for a different perspective are inverted views with respect to FIGS. 1 and 2, show that the first layer deposited over orifice plate 40 is an insulative layer 44. Layer 44 provides both electrical and thermal insulation. The resistive layer 46 and conductive layer 48 are then formed on top of the insulative layer 44 [see FIG. 3(*c*)]. Conventional chemical vapor deposition, photo-lithography, sputtering, and electrodeposition known to the semiconductor fabrication art are used throughout this manufacturing process. Silicon dioxide is often used to form layer 44, but other materials can be used, such as those listed in the Table 1:

TABLE 1

| Insulative Layer 44 Materials | | | |
|---|---|---|---|
| Oxides | Nitrides | Carbides | Polymers |
| Aluminum oxide | Silicon nitride | Boron carbide | Polyimide |
| Tantalum oxide | Aluminum nitride | Silicon carbide | Photoresist |
| Silicon oxide | Boron nitride | | |

FIGS. 3(*d*)–3(*g*) show that, after the foregoing layers are in place, photolithographic processes are used to define the resistive and conductive patterns. An ink channel layer, for example a dry film resist such as Vacrel, is then laminated to orifice plate 40, and a plurality of ink distribution channels 37 are formed. Once all the insulative, resistive, conductive, and ink distribution structures are formed on plate 40, an ink reservoir 32 is attached to it through a pipe 31 for delivering ink to an ink region 56.

Both the conductive and resistive layers are deposited directly on an orifice plate to form many ink jets on one structure. The first layer that is deposited on the orifice plate is an insulator 44, which is typically silicon dioxide. A resistive layer 46 of for example tantalum aluminum alloy is then formed over the insulative layer. A conductive layer 48 such as gold is formed or otherwise placed on top of this resistive layer.

Then, in a step important to formation of a resistor 45 in a localized region of resistive material 46 formation, portions of gold conductor 48 are removed to form a gap 33, gap 33 thus splitting conductor layer 48 into conductor strips 48*a* and 48*b*. Gap 33 exposes small portions of the resistive tantalum aluminum alloy below the gold layer; this resistive region becomes resistor 45. In the region of gap 33, the gold layer exists as a first gold segment 48*a* and a second gold segment 48*b*, electrically connected across the gap by the resistive layer which can now function as resistor 45.

Resistor 47 heats the ink by the following process. The gap or break in the gold layer functions as a heating zone for heating liquid ink residing there after being drawn from a reservoir. When an electrical potential difference is applied quickly across the gap in the now-separated gold layer, a current pulse surges (a) through the first gold segment, (b) into the resistor formed from the resistive layer, and (c) out through the second gold segment; alternatively, the current can be made to flow in the opposite direction. This current pulse heats the resistor rapidly to a high temperature, thereby quickly heating the ink that is in contact with the resistor.

The heated ink is formed into uniform reproducible bubbles that are created within gap 33 between separate gold layers 48*a* and 48*b*. Bubble formation is explosive; ink is propelled from the print head through orifices 42 located to one side (off-center) of each orifice 42. The present invention permits the construction of multiple print head arrays in a single orifice plate, thereby permitting fabrication of complex ink drop delivery patterns.

FIGS. 4(*a*)–4(*e*), which for a different presentation is inverted with respect to FIGS. 1 and 2 but aligned in the same orientation as FIG. 3, show isometric drawings illustrating formation stages of orifice plate 40 and integral ink heating structure 39.

FIGS. 4(*a*) and 4(*b*) show orifice plate 40 defining orifices 42 that will form the nozzle for each ink jet. Four successive layers are formed over plate 40: an insulative layer 44, a resistive layer 46, a conductive layer 48, and a photoresist 50. Through orifices or holes 42, a group of shafts 49 are formed to penetrate an entire assembly of layers 55. Photolithographic processes are now applied to the FIG. 4(*b*) assembly 55, with the result shown in FIG. 4(*c*).

FIG. 4(*c*) shows that, after a photolithographic mask (not shown) is aligned to selectively cover portions of substrate 50, photoresist 50 is exposed to light, developed, and baked onto the conductive layer 48 below it. The result is a photoresist pattern 52, shaped like a single long stem 53 with many radiating branches 54 that are flared at their ends away from stem 53. Pattern 52 protects conductive layer 48 and resistive layer 46 below during the next step, with the result shown in FIG. 4(*d*).

FIG. 4(*d*) shows that when a photolithographic chemical etching solution (not shown) is used to remove portions of conductive layer 48 and resistive layer 46 materials not covered over by resist pattern 52, thus forming a main current conductor or stem 53 and heating elements or structures 39.

FIG. 4(*d*) and 2 show that when heating element 39 is viewed in cross-section looking toward stem 53, the same cross-section appears in both drawing. Additional photolithographic and etching procedures are then used to strip away a small portion of conductive material 48 from the resistive material 46 below it. FIG. 4(*d*) shows that each heating structure 39 includes a central region 57 between stem 53 and flared branches 54 where gold conductor 48 is separated into two separate regions 48*a* and 48*b*, to form one of the ink heating zones 38 described above.

FIG. 4(*e*) shows the result of the next photolithographic step. Those portions of photoresist 50 remaining on top of gold 48 is removed, leaving conductor layer 48 is the exterior layer of heating structures 39 connected to stem 54. FIG. 4(*e*) shows printhead 26 after ink channels and barriers 37 have been defined.

Orifice plate 40 now includes integral heating structure 39 and ink channels and barriers 37.

An alternative embodiment of the present invention may use an orifice plate 40 which is formed from a metal other than nickel or a plastic material.

Insulative layer 44 can be made from such dielectric materials or films as silicon oxide, nitride, carbide, or photoresist. Ink channel material 37 can be plated metal such as nickel, a plated alloy like nickel phosphorous, nickel cobalt or nickel chromium, or a commonly available photoresist such as Vacrel or Riston. If a plated ink channel 37 is employed, an additional insulative layer (not shown) between the conductive layer 48 and ink channel layer 37 is required.

Claims Define the Invention. The foregoing Detailed Description and Drawings present specific examples of the claimed invention. The particular illustrated preferred embodiments by definition have a narrow scope suitable for showing the best mode for practicing the invention.

However, it is the following appended claims that actually (a) define the invention and (b) establish the broad scope of the invention.

The invention claimed is:

1. A method of forming an integral ink jet print head, the method comprising the steps of:

(a) forming an orifice plate defining through itself at least one orifice;

(b) forming an insulative layer over at least a portion of the plate and over a surface area thereof defining said orifice;

(c) forming a resistive layer over a portion of the insulative layer;

(d) forming an electric current conductive layer over a portion of the resistive layer and coextensive therewith over a portion of said orifice plate, whereby all of said insulative, resistive and conductive layers terminate at an ink ejection surface of said orifice plate;

(e) forming a pattern in said conductive layer which defines one or more dimensions of a heater resistor area within said resistive layer; and (f) forming at least one ink distribution channel adjacent said heater resistor area whereby one or more of said insulative, resistive or conductive layers may be left in place on the surface of said orifice plate or etch-removed therefrom.

2. A method as claimed in claim 1 in which the plate is etched from a metal.

3. A method as claimed in claim 1 in which the plate is an electroformed metal.

4. A method as claimed in claim 3 in which the metal is nickel.

5. A method as claimed in claim 3 in which the metal is a nickel alloy.

6. A method as claimed in claim 3 in which the metal is copper.

7. A method as claimed in claim 1 in which the plate is plastic.

8. A method as claimed in claim 7 in which the plate is etched from a plastic.

9. A method as claimed in claim 7 in which the plate is molded from a plastic.

10. A method as claimed in claim 1 in which the plate is a glass.

11. A method as claimed in claim 10 in which the plate is formed from one of etching a glass and molding a glass.

12. A method as claimed in claim 1 in which the plate is silicon.

13. A method as claimed in claim 13 in which the plate is etched from silicon.

14. A method as claimed in claim 1 in which the insulative layer is fabricated from one of an oxide, a nitride, a carbide, and a boride.

15. A method as claimed in claim 1 in which the insulative layer is a photoresist.

16. A method as claimed in claim 1 in which the insulative layer is a polymer.

17. A method as claimed in claim 1 in which the resistive layer is one of a metal, a mixture of a plurality of metals, and an alloy.

18. A method as claimed in claim 17 in which the resistive layer is tantalum-aluminum.

19. A method as claimed in claim 1 in which the conductive layer is formed from one of the group of gold, aluminum, nickel, and copper.

20. A method of forming an integral ink jet print head, the method comprising the steps of:

(a) forming an orifice plate defining through itself at least one orifice;

(b) forming a resistive layer over a portion of the orifice plate;

(c) forming an electric current conductive layer over a portion of the resistive layer, said resistive and conductive layers being substantially coextensive over a portion of said orifice plate and terminating at an ink ejection surface of said orifice plate, and the orifice opening diameter being normally defined by an opening in said insulative layer;

(d) forming at least one electric current conductive pattern coupled to said resistive layer; and (e) forming at least one ink distribution channel adjacent said resistive layer, whereby one or more of said insulative, resistive or conductive layers may be left in place on the surface of said orifice plate or etch-removed therefrom.

21. A method as claimed in claim 20 in which the plate is a plastic.

22. A method as claimed in claim 21 in which the plate is etched from a plastic.

23. A method as claimed in claim 20 in which the plate is molded from a plastic.

24. A method as claimed in claim 20 in which the plate is a glass.

25. A method as claimed in claim 24 in which the plate is etched from a glass.

26. A method as claimed in claim 20 in which the plate is silicon.

27. A method as claimed in claim 26 in which the plate is etched from silicon.

28. An integral ink jet print head, formed for transferring an ink from an ink reservoir to a print medium such as paper by heating the ink with a resistor through which is pulsed an electric current from a source of electric current, the print head comprising:

(a) an orifice plate, defining through itself at least one orifice;

(b) an insulative layer, formed over at least a portion of the orifice plate;

(c) a resistive layer, formed over at least a portion of the insulative layer;

(d) an electric current conductive layer, formed over the resistive layer, in such a manner as to produce at least one resistor capable when carrying an electric current of generating heat, thereby establishing at least one resistive heating region adjacent at least one orifice, said insulative, resistive and conductive layers all being substantially coextensive over a portion of said orifice plate and extending to or toward an ink ejection surface of said orifice plate where an opening in one or more of the insulative, resistive or conductive layers determines the orifice opening diameter, and ink delivered from the ink reservoir to said resistor will be heated such that some of the ink adjacent the resistor vaporizes to form at least one vapor bubble which displace at least some of the ink, causing at least some of the ink to be ejected through the orifice.

29. A method of forming an integral orifice plate and resistive heater circuit and structure useful for further bonding to an ink feed housing or the like, which comprises the steps of:

(a) providing as a process starting material an orifice plate having inner and outer major surfaces and one or more orifice openings therethrough which extend from said inner major surface to said outer major surface and terminate at a constricted opening at said outer major surface, (b) forming an insulative layer extending over the surface of said orifice opening and in a convergent contour toward said constricted opening in said ink ejection orifice plate surface, (c) forming a resistive layer over said insulative layer and being substantially coextensive therewith over a portion of said orifice plate surface adjacent to said orifice opening, (d) forming a conductive layer over said resistive layer and being substantially coextensive therewith over a portion of said orifice plate surface adjacent to said orifice opening, and (e) forming pattern in said conductive layer which defines one or more dimensions of a heater resistor area within said resistive layer and located adjacent to said orifice opening, whereby a portion of said conductive layer may be subsequently aligned with and bonded to an ink feed housing of a disposable ink jet pen or the like, and said conductive and resistive layers may subsequently etch removed from the convergent contour of said orifice opening, leaving said insulative layer as a protective coating for said orifice plate.

30. The method defined in claim 29 wherein said orifice plate is a material selected from the group consisting of metals, insulators, and semiconductors.

31. The method defined in claim 30 wherein said metals are selected from the group consisting of a single metal, a mixture of a plurality of metals, and an alloy; said insulating layer being of a material selected from the group consisting of an oxide, a nitride, a carbide, and a boride; and said conductive layer being of a material selected from the group consisting of gold, aluminum, nickel, and copper.

32. An integrated orifice plate and resistive heater circuit and structure useful for attachment to an ink feed housing for a disposable thermal ink jet pen or the like, including, in combination:

(a) an orifice plate having inner and outer major surfaces and one or more orifice openings extending therethrough from said inner major surface and converging to a constricted ink ejection opening on said outer major surface of said orifice plate, (b) an insulative layer extending over a portion of said inner major surface and over said convergent orifice opening surface and terminating at said outer major surface of said orifice plate, (c) a resistive layer formed on the surface of said insulative layer and adjacent to said convergent orifice opening, (d) a conductive layer formed on the surface of said resistive layer and adjacent to said convergent orifice opening, whereby one or more of said insulative, resistive and conductive layers may be etch removed from the surface of said convergent orifice opening, and (e) a pattern formed in said conductive layer exposing an adjacent area of said resistive layer to thereby define one or more dimensions of a resistive heater element within said resistive layer and located adjacent to said convergent orifice opening, whereby a portion of said conductive layer remaining on said resistive layer may be aligned with and bonded to an ink feed housing of a disposable ink jet pen or like.

33. The article of manufacture defined in claim 32 wherein said orifice plate is of a material selected from the group consisting of metals, insulators, and semiconductors.

34. The article of manufacture defined in claim 32 wherein said insulative layer is a material selected from the group consisting of an oxide, a nitride, a carbide, a boride, or a polymer.

35. The article of manufacture defined in claim 32 wherein said resistive layer is a material selected from the group consisting of a metal, a mixture of a plurality of metals, and an alloy such as tantalum aluminum.

36. The article of manufacture defined in claim 32 wherein said orifice plate is a material selected from the group consisting of silicon, glass, or plastic.

37. The article of manufacture defined in claim 32 wherein said conductive layer is of a material selected from the group consisting of gold, aluminum, nickel, and copper.

* * * * *

UNITED STATES PATENT AND TRADEMARK OFFICE

CERTIFICATE OF CORRECTION

PATENT NO. : 5,016,024

DATED : May 14, 1991

INVENTOR(S) : Si-Ty Lam & William J. Lloyd

It is certified that error appears in the above-identified patent and that said Letters Patent is hereby corrected as shown below:

Column 9, line 37, "forming pattern" should read -- forming a pattern --;

Column 3, line 12, "head that is" should read -- head is --;

Column 3, line 13, "Additional features the" should read -- Additional features of the --;

Column 8, line 3, "claim 13 in" should read -- claim 12 in --.

Signed and Sealed this

Thirtieth Day of August, 1994

*Attest:*

*Attesting Officer*

Bruce Lehman

BRUCE LEHMAN

*Commissioner of Patents and Trademarks*